US005660313A

United States Patent [19]

Newbold

[11] Patent Number: 5,660,313

[45] Date of Patent: Aug. 26, 1997

[54] PREMOISTENED TOILET PAPER AND DISPENSER

[76] Inventor: Harry L. Newbold, 2344 Silversides Loop, Pensacola, Fla. 32526

[21] Appl. No.: 510,605

[22] Filed: Aug. 3, 1995

[51] Int. Cl.[6] ..... B65H 16/06

[52] U.S. Cl. ..... 225/42; 206/205; 206/233; 206/409; 225/43; 242/598.6

[58] Field of Search ..... 206/205, 209, 206/210, 229, 390–394, 408–410, 397, 812; 225/39–52; 242/596, 596.8, 598.6, 579, 580

[56] References Cited

U.S. PATENT DOCUMENTS

| | | | |
|---|---|---|---|
| 2,253,744 | 8/1941 | Witt | 225/42 |
| 2,276,414 | 3/1942 | Morehouse et al. | 225/42 |
| 2,440,974 | 5/1948 | Resch | 206/205 |
| 2,462,776 | 2/1949 | Price | 225/42 |
| 3,368,522 | 2/1968 | Cordis | 225/40 |
| 3,756,483 | 9/1973 | Schraeder | 225/52 |
| 3,910,229 | 10/1975 | Spencer | 118/43 |
| 4,002,264 | 1/1977 | Marchesani | 206/205 |
| 4,101,026 | 7/1978 | Bonk | 206/205 |
| 4,451,943 | 6/1984 | Nibler | 4/661 |
| 4,936,452 | 6/1990 | Pauley | 206/409 |
| 5,044,556 | 9/1991 | Suzuki | 239/135 |
| 5,311,986 | 5/1994 | Putz | 206/233 |
| 5,368,157 | 11/1994 | Gasparini et al. | 206/209 |
| 5,375,616 | 12/1994 | Chen | 134/105 |
| 5,439,521 | 8/1995 | Rao | 242/598.6 |

*Primary Examiner*—Jimmy G. Foster
*Attorney, Agent, or Firm*—Joseph N. Breaux

[57] ABSTRACT

A premoistened toilet paper and dispenser of the type having a pre-moistened roll of fabric sheets disposed in a dispenser connectably with a conventional toilet roll holder is provided. The premoistened toilet paper and dispenser comprises: a dispenser housing defining a cavity therein, the housing defining a slot in connection with the cavity and having a first and second sidewall connectable to a conventional toilet paper roll holder and premoistened toilet paper formed in a roll about a tube, the toilet paper being rotatably disposed within the cavity of the housing and a first end of the toilet paper being disposed through the slot exterior the housing, the tube being adapted for passing a conventional toilet paper dowel.

1 Claim, 2 Drawing Sheets

FIG. 5

PREMOISTENED TOILET PAPER AND DISPENSER

TECHNICAL FIELD

The present invention relates to devices for dispensing rolls of premoistened sheets and more particularly to devices for dispensing rolls of premoistened sheets that are maintained in a housing connectable to a conventional toilet roll holder for use in a bathroom setting.

BACKGROUND ART

After moving the bowels, we clean the anal region with toilet paper for personal cleanliness. However, in case of using dry toilet paper, it is uncomfortable to wipe feces off the region. It is especially painful for victims of piles to wipe the anal region with dry toilet paper. To lessen the pain, some victims use wet tissue paper. However, wet tissue paper often deteriorated resulting in an equally unpleasant situation.

It would be a benefit, therefore, to have a premoistened toilet paper and dispenser that has a roll of premoistened fabric sheets which will not deteriorate. It would be a further benefit to have a premoistened toilet paper and dispenser that has an enclosed dispenser housing which prevents the premoistened toilet paper from drying. It would be an additional benefit to have a premoistened toilet paper and dispenser that is connectable to a conventional toilet paper holder.

GENERAL SUMMARY DISCUSSION OF INVENTION

It is thus an object of the invention to provide a premoistened toilet paper and dispenser that has a roll of premoistened fabric sheets which will not deteriorate.

It is a further object of the invention to provide a premoistened toilet paper and dispenser that has an enclosed dispenser housing which prevents the premoistened toilet paper from drying.

It is a still further object of the invention to provide a premoistened toilet paper and dispenser that is connectable to a conventional toilet paper holder.

Accordingly, a premoistened toilet paper and dispenser of the type having a pre-moistened roll of fabric sheets disposed in a dispenser connectably with a conventional toilet roll holder is provided. The premoistened toilet paper and dispenser comprises: a dispenser housing defining a cavity therein, the housing defining a slot in connection with the cavity and having a first and second sidewall connectable to a conventional toilet paper roll holder and premoistened toilet paper formed in a roll about a tube, the toilet paper being rotatably disposed within the cavity of the housing and a first end of the toilet paper being disposed through the slot exterior the housing, the tube being adapted for passing a conventional toilet paper dowel.

The dispenser housing may be made of any rigid material or cardboard. The interior of a cardboard housing may be lined with wax or other substance to prevent the premoistened sheets from drying. The toilet paper may be made of any soft fibrous material. Preferably, the toilet paper is a fabric material.

The housing must have a slot for passing an end of the roll of sheets through. A lip or cutting mechanism may extend from the surface of the housing adjacent the slot for tearing the fabric sheets. The roll of fabric sheets may be perforated to aide in tearing the sheets. A tongue may extend into the slot to maintain a portion of the roll of fabric sheets exterior of the housing.

The housing may be constructed as a unitary housing about the roll of sheets so that the unit may be disposed of when the supply of premoistened sheets is exhausted. The housing may be constructed in two symmetrical sections facewise disposed upon each and hingedly connected along one edge so that a new roll of fabric sheets may be inserted when the original supply is exhausted. A fastening mechanism releasably connects the two sections. The fastening mechanism may include a tab engageable with a stud, a hook and eyelet or any device known the art for releasably connecting the two sections.

The sidewalls are removably connectable with a conventional toilet paper roll holder. The sidewalls may have spring loaded pins mounted in the center of the sidewalls for engaging the toilet roll holder. Preferably, concentric ports are centered on the first and second sidewalls of the housing and are concentrically aligned with tube of the roll of fabric sheets for passing a dowel therethrough and connecting to a conventional toilet roll holder.

The housing may be concentric with the slot aligned along the longitudinal axis of the housing. The housing may be concentric with a planar surface adapted for contacting the bathroom wall so that the housing does not rotate when sheets are being dispensed.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
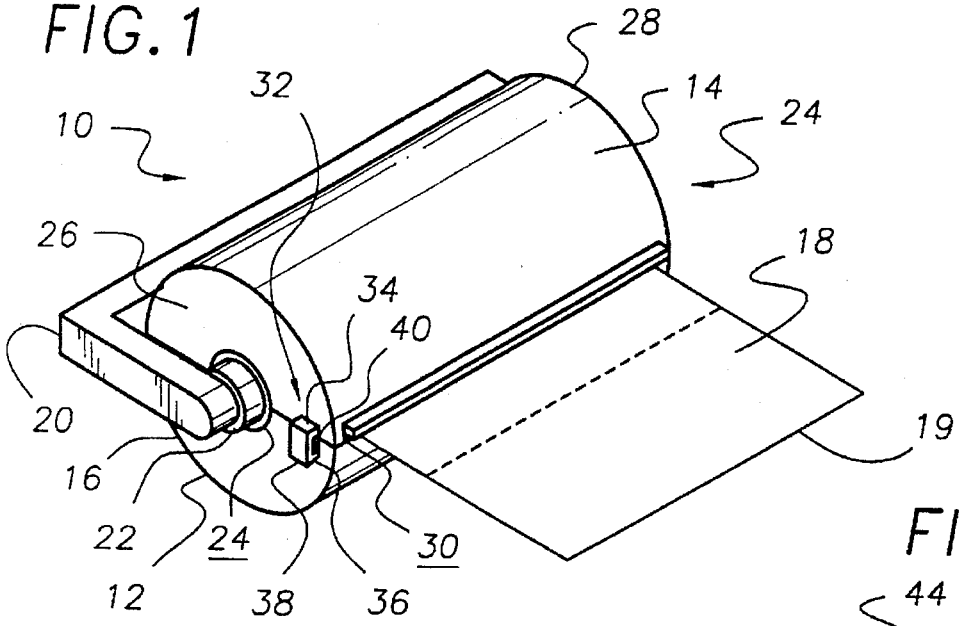
FIG. 1 is an isometric view of an exemplary embodiment of the premoistened toilet paper and dispenser of the present invention.

FIG. 1 is an isometric view of an exemplary embodiment of the premoistened toilet paper and dispenser of the present invention generally designated by the numeral 10. Premoistened toilet paper and dispenser 10 includes a dispenser housing 12 having a top section 14 and a bottom section 16 and a roll of pre-moistened fabric sheets 18 disposed in dispenser 10. Dispenser 12 is adapted to be connected to a standard toilet paper holder 20 and dowel 22.

Dispenser 12 is made of a rigid plastic. Top 14 and bottom 16 are symmetrical facewise disposed upon each other. Top and bottom 16 are hingedly connected along a longitudinal edge (not shown). Dispenser 12 has concentric ports 24 centered on its first and second sidewalls 26, 28 for passing dowel 22 through dispenser 12 and toilet paper roll 18. A longitudinal slot 30 is defined by top 14 and bottom 16 for dispensing a first end 19 of toilet paper 18.

A locking mechanism 32 releasably maintains top section 14 in a closed relationship with bottom section 16. Locking mechanism 32 includes a tab 34 extending vertically from first sidewall 26 of top segment 14. A tooth member 36 extends perpendicularly from a distal end 38 of tab 34 for releasably engaging a stud 40. Stud 40 extends from first sidewall 26 of bottom segment 16.

Figure 2:
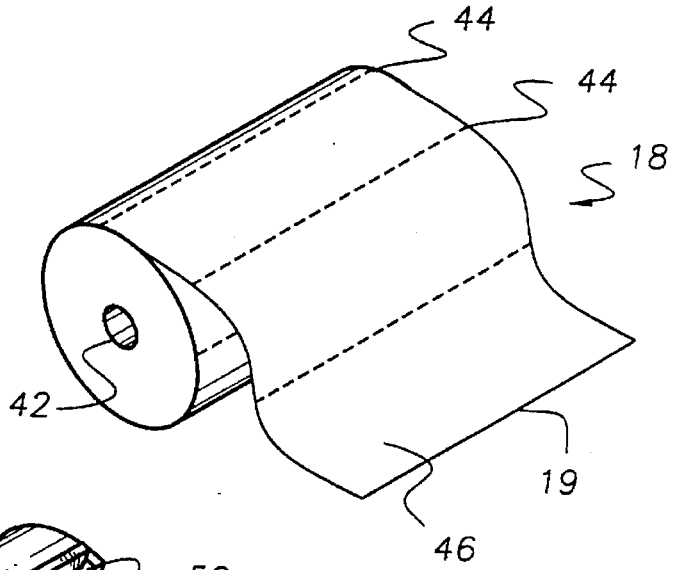
FIG. 2 is an isometric view of a roll of moistened toilet paper.

FIG. 2 is an isometric view of a roll of moistened toilet paper 18. Toilet paper 18 is formed of an elongated sheet of pre-moistened fabric material having a first end 19 and may include a disinfectant. Toilet paper 18 is wrapped around a cardboard tube 42 for disposing dowel 22. Toilet paper 18 has transverse perforations 44 spaced along its length dividing toilet paper 18 into sheets 46.

Figure 3:
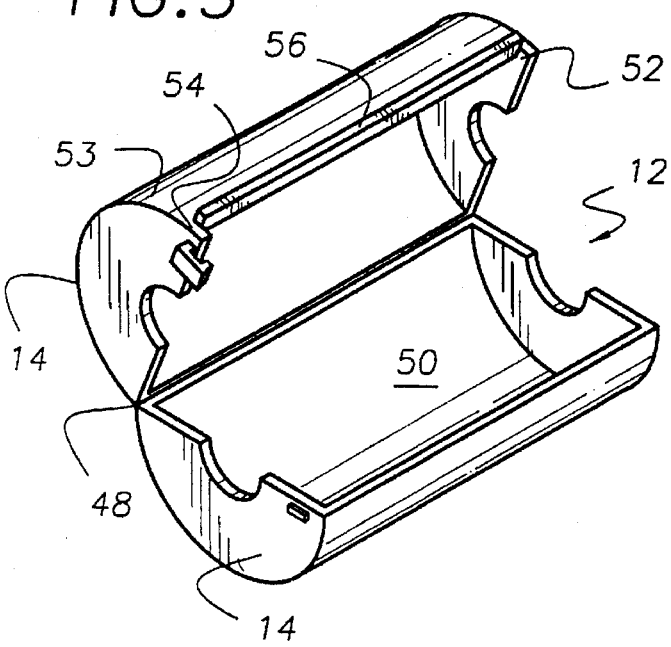
FIG. 3 an isometric view of the dispenser.

FIG. 3 is an isometric view of dispenser 12. Top 14 and bottom 16 are connected by hinges 48. Dispenser 12 has a cavity 50 formed therein for disposing toilet paper 18 (FIG. 2). Top 14 has recessed section 52 along its front edge 54 to form slot 30 (FIG. 1). A lip 56 extends perpendicularly from the exterior surface 53 adjacent slot 30.

Figure 4:
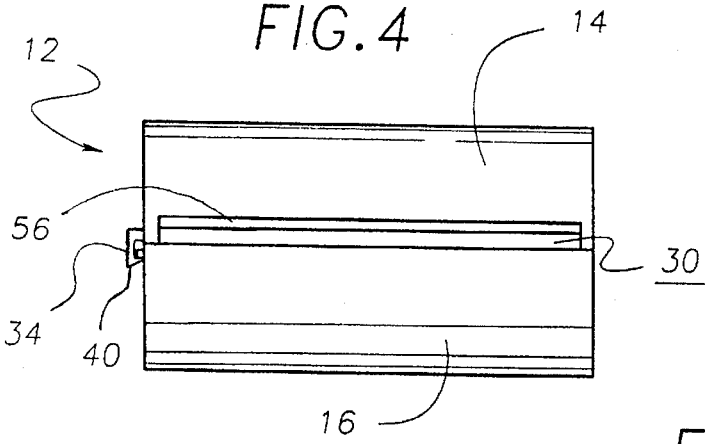
FIG. 4 is a front view of the dispenser.

FIG. 4 is a front view of dispenser 12. The figure shows slot 30 formed between top 14 and bottom 16. Lip 56 is located above slot 30. Tab 34 releasably engages stud 40 maintaining top 14 and bottom 16 in a closed relationship.

Figure 5:
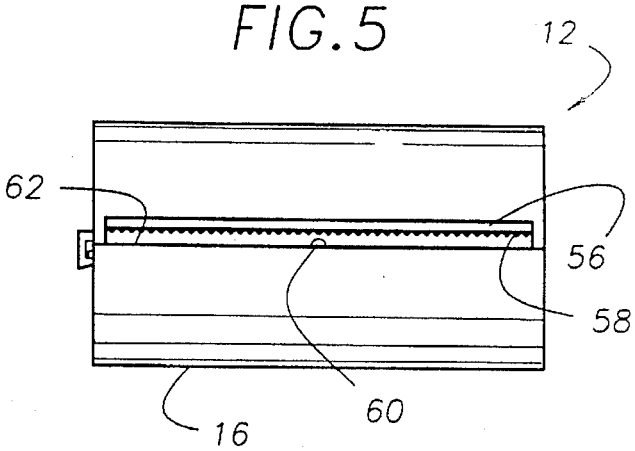
FIG. 5 is a front view of another embodiment of the dispenser.

FIG. 5 is a front view of another embodiment of dispenser 12. The figure shows serrated teeth 58 extending towards bottom 16 from lip 56. Teeth 56 are made of a thin metallic strip and aid in tearing toilet paper 18 along perforations 44 (FIG. 2).

A tongue 60 is centered and extends perpendicularly from a top edge 62 of bottom 16. Tongue 60 prevents toilet paper 18 from rolling back into dispenser 12.

Figure 6:
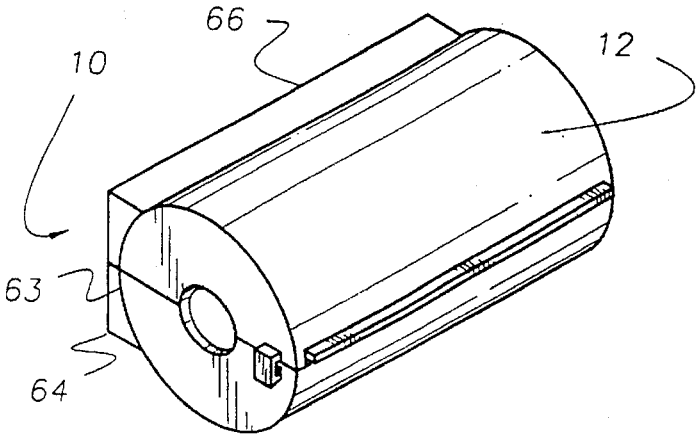
FIG. 6 is an isometric view of another embodiment of the premoistened toilet paper and dispenser of the present invention.

FIG. 6 is an isometric view of another embodiment of the premoistened toilet paper and dispenser of the present invention generally designated by the numeral 10. In this embodiment a rectangular section 64 having a planar surface 66 extends from a back surface 68 of dispenser 12. Planar surface is adapted for contacting a bathroom wall (not shown) so that dispenser 12 does not rotate about dowel 22 (FIG. 1).

Figure 7:
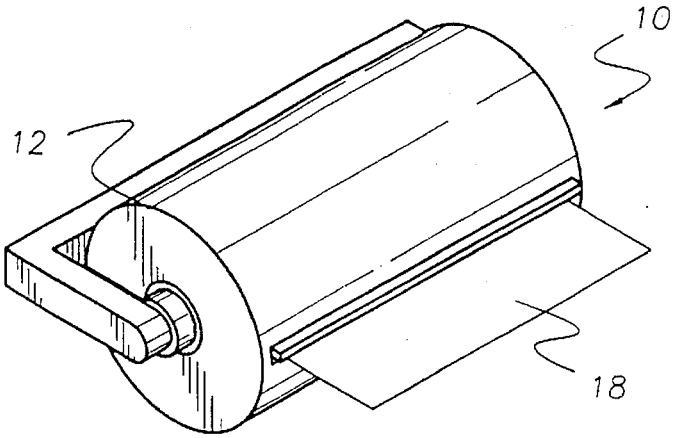
FIG. 7 is an isometric view of yet another embodiment of the premoistened toilet paper and dispenser of the present invention.

FIG. 7 is an isometric view of yet another embodiment of the premoistened toilet paper and dispenser of the present invention generally designated by the numeral 10. In this embodiment dispenser 12 is constructed of cardboard in a single unit about moistened toilet paper roll 18. Dispenser 12 is substantially similar to dispenser 12 in FIG. 1 in all other respects. Toilet paper 18 is of the same type as shown in FIG. 2. In this embodiment premoistened toilet paper and dispenser 10 is inexpensive and disposable.

It can be seen from the preceding description that a device for dispensing rolls of premoistened toilet sheets which has a roll of premoistened fabric sheets which will not deteriorate, an enclosed dispenser housing which prevents the premoistened toilet paper from drying and is connectable to a conventional toilet paper holder has been provided.

It is noted that the embodiment of the premoistened toilet paper and dispenser described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A premoistened toilet paper and dispenser comprising:

a dispenser housing defining a cavity therein, said housing defining a slot in connection with said cavity and having a first and second sidewall, connectable to a toilet paper roll holder having depressions for rotatably receiving the first and second ends of a dowel, and a rectangular section extending from a back surface of said housing opposite said slot and having a planar surface for contacting a bathroom wall in a manner to prevent said housing from rotating when said dispenser housing is in connection with said toilet paper roll holder, said housing including a top section; and a bottom section hingedly connected to said top section;

premoistened toilet paper formed in a roll about a tube, said toilet paper being disposed within said cavity of said housing and a first end of said toilet paper being disposed through said slot and extending exteriorly of said housing, said tube being adapted for passing a toilet paper dowel, said roll of toilet paper being formed of a fabric material and having transverse perforations spaced along its length dividing said toilet paper into sheets;

a fastening mechanism in connection between said top section and said bottom section for releasably securing said top and bottom section in a closed relationship;

a lip extending perpendicularly from an exterior surface of said top section adjacent said slot;

serrated teeth extending from said lip towards said slot for tearing said toilet paper; and a tongue extending from a top edge of said bottom section into said slot for maintaining a portion of said toilet paper exterior said housing.

* * * * *